US007651659B2

(12) United States Patent
Ichikawa et al.

(10) Patent No.: US 7,651,659 B2
(45) Date of Patent: Jan. 26, 2010

(54) MANUFACTURING METHOD OF SINTER FORGED ALUMINUM PARTS WITH HIGH STRENGTH

(75) Inventors: Junichi Ichikawa, Chiba (JP); Kenzo Morita, Chiba (JP)

(73) Assignee: Hitachi Powdered Metals Co., Ltd. (JP)

( * ) Notice: Subject to any disclaimer, the term of this patent is extended or adjusted under 35 U.S.C. 154(b) by 0 days.

(21) Appl. No.: 10/957,559

(22) Filed: Oct. 1, 2004

(65) Prior Publication Data

US 2005/0079085 A1 Apr. 14, 2005

(30) Foreign Application Priority Data

| | | |
|---|---|---|
| Oct. 2, 2003 | (JP) | P2003-345001 |
| Jul. 14, 2004 | (JP) | P2004-206957 |
| Aug. 30, 2004 | (JP) | P2004-249392 |

(51) Int. Cl.
*B22F 3/12* (2006.01)

(52) U.S. Cl. ..... 419/26; 419/28; 419/29

(58) Field of Classification Search ..... 419/28–29, 419/26

See application file for complete search history.

(56) References Cited

U.S. PATENT DOCUMENTS

| | | | | |
|---|---|---|---|---|
| 3,816,080 | A * | 6/1974 | Bomford et al. | 75/233 |
| 4,853,179 | A * | 8/1989 | Shiina | 419/28 |
| 4,959,195 | A * | 9/1990 | Kusui et al. | 419/67 |
| 5,498,393 | A * | 3/1996 | Horimura et al. | 419/28 |
| 5,561,829 | A * | 10/1996 | Sawtell et al. | 419/13 |
| 5,614,036 | A * | 3/1997 | Imahashi et al. | 148/437 |
| 5,878,323 | A * | 3/1999 | Sakai et al. | 419/28 |
| 5,902,943 | A * | 5/1999 | Schaffer et al. | 75/249 |
| 5,976,214 | A | 11/1999 | Kondoh et al. | |
| 6,134,779 | A * | 10/2000 | Walker et al. | 29/888.092 |
| 6,159,419 | A * | 12/2000 | Kondoh et al. | 419/13 |
| 6,468,468 | B1 * | 10/2002 | Neubing et al. | 419/38 |
| 6,902,699 | B2 * | 6/2005 | Fritzemeier et al. | 419/38 |
| 2003/0215348 | A1 * | 11/2003 | Ichikawa et al. | 419/23 |
| 2004/0013558 | A1 * | 1/2004 | Kondoh et al. | 419/36 |
| 2005/0034559 | A1 * | 2/2005 | Lindenau et al. | 75/249 |

FOREIGN PATENT DOCUMENTS

| | | |
|---|---|---|
| EP | 0180144 A | 5/1986 |
| JP | 11-504388 | 4/1999 |
| WO | WO 96/34991 | 11/1996 |

* cited by examiner

*Primary Examiner*—Harry D. Wilkins, III
*Assistant Examiner*—Nicholas A. Smith
(74) *Attorney, Agent, or Firm*—Kilpatrick Stockton LLP

(57) ABSTRACT

Disclosed is a manufacturing method of sinter forged aluminum-based parts with high strength. In the manufacturing method, prepared is a raw material powder comprising, by mass: 3.0 to 10% zinc; 0.5 to 5.0% magnesium; 0.5 to 5.0% copper; inevitable amount of impurities; and the balance aluminum. The raw material powder is formed into a compact by pressing the raw material powder, sintered in a non-oxidizing atmosphere in such a manner as to heat the compact at a sintering temperature of 590 to 610 degrees C. for 10 minutes or more, before cooling the sintered compact. It is then forged by pressing the sintered compact in a pressing direction to compress the sintered compact in the pressing direction and produce plastic flow of material in a direction crossing to the pressing direction.

17 Claims, No Drawings

MANUFACTURING METHOD OF SINTER FORGED ALUMINUM PARTS WITH HIGH STRENGTH

BACKGROUND OF THE INVENTION

1. Field of the Invention

The present invention relates to a method of manufacturing sinter forged aluminum parts with high strength that are suitable as various kinds of members for structure use and base material for plastic-working use. More particularly, the invention concerns a method of manufacturing sinter forged aluminum parts with high strength that are improved in elongation as well as in tensile strength.

2. Related Art

Regarding the aluminum sintered parts manufactured with the use of a powder-metallurgical method, there has been an increasing demand in recent years, since they are not only light in weight but also possible to possess preferable properties that cannot be obtained with cast materials, such as strength, wear resistance and the like. As the conventional aluminum sintered alloys, Al—Si—Cu-based alloys have been predominant, and they have been applied to the structural materials and wear-resistant materials. However, since the Al—Si—Cu-based sintered alloys are to an extent of 300 MPa or so in terms of the strength even when they are subjected to forging and heat treatment, the application of them is limited and sintered aluminum materials with a higher level of strength has been therefore expected to be produced.

Under the above-described circumstances, in regard to the sintered aluminum materials with a further high level of strength, Japanese Patent Application National Publication (Laid-Open) No. 11-504388 (PCT Application of International Publication No. WO96/34991) proposes a process for manufacturing, with the powder-metallurgical method, an aluminum alloy of 7000 series in International Designation System by aluminum Association, that is known as extra super duralumin, and describes in its Examples that aluminum alloy exhibits a tensile strength of 305 to 444 MPa and an elongation of 0.6 to 5.6%. However, according to the above process, if the aluminum alloy has a tensile strength exceeding 400 MPa, its elongation is 1.1% or less, and, if the aluminum alloy has an elongation of 5% or more on the contrary, its tensile strength is around 300 MPa. In short, it is not such a material that exhibits a high level of property in terms of both of the tensile strength and the elongation.

In recent years, a great demand for making the products lighter in weight has existed in the field of automobile parts, terminal machines for use as electronic materials, precision machine parts or the like. If there is provided a sintered aluminum alloy that has a strength that is equivalent to general steel products, the range of use as well as the purpose of use is possibly made wide.

BRIEF SUMMARY OF THE INVENTION

With the above problems in mind, it is therefore an object of the present invention to provide a novel method of manufacturing a sintered aluminum part having a higher strength such that both of a high tensile strength and a high elongation are simultaneously accomplished.

In order to achieve the above-mentioned object, a method of manufacturing a sinter forged aluminum-based part according to the present invention comprises: preparing a raw material powder comprising, by mass: 3.0 to 10% zinc; 0.5 to 5.0% magnesium; 0.5 to 5.0% copper; inevitable amount of impurities; and the balance aluminum; forming the raw material powder into a compact by pressing the raw material powder; sintering the compact in a non-oxidizing atmosphere in such a manner as to heat the compact at a sintering temperature of 590 to 610 degrees C. for 10 minutes or more, before cooling the sintered compact; and forging the sintered compact by pressing the sintered compact in a pressing direction to compress the sintered compact in the pressing direction and produce plastic flow of material in a direction crossing to the pressing direction.

In accordance with use of the raw powder having the above-described ingredient composition, $MgZn_2$ (η-phase), $Al_2Mg_3Zn_3$ (T-phase), or $CuAl_2$ (θ-phase) is precipitated and dispersed in the aluminum matrix of the obtained aluminum part, and it is possible to provide an aluminum part which has a high strength and a high elongation. In addition, since the forging step according to the present invention enables not only to close the pores of the sintered mass but also to obtain metallic bond after closing the pores, that makes possible, together with the effects of the above-described raw powder, to realize an aluminum part having a very high level of strength and elongation.

The features and advantages of the manufacturing method according to the present invention over the conventional art will be more clearly understood from the following description of the preferred embodiments of the present invention.

DETAILED DESCRIPTION OF THE INVENTION

The inventors of the present application has continued to make a lot of studies and researches concerned in view of the above-described conventional background of technique. As a result, they have come to have the knowledge that there are a few effective factors for obtaining a sinter forged part having a tensile strength of 500 MPa or more and an elongation of 2% or more which cannot be expected from the sintered aluminum parts that are provided in the prior art, and those can include: specifying the blending ratio and the forms of powdered raw materials in the step of preparing a raw material powder to be compacted; specifying the compacting conditions for the raw material powder in a step of forming a compact of the raw material powder; specifying the sintering conditions for the obtained compact in a step of sintering the formed compact; and performing a cold or hot forging with respect to the sintered compact thus obtained at a predetermined value of upsetting ratio; and, after forging, performing heat treatment under predetermined conditions as the necessity arises, and the present invention has been completed.

Hereinafter, the embodiments of the present invention will be described, explaining every step of the manufacturing method in detail. It is to be noted that, in the description of the present application, Al, Zn, Mg and the like are symbols of the elements used, and that the term, "aluminum part(s)", should be read as meaning "aluminum-based part(s)" or part(s) being composed mainly of aluminum and possibly containing small amounts of other elements. Moreover, "sintering temperature" means the maximum temperature at which the compact is sintered, and sintering time means the time period during which the compact is at sintering temperature.

(1) Raw Material Powder Blending Step

In this step, a raw material powder to be compacted is prepared by blending the respective powdered raw materials as to which the details are described below.

(1)-1 Ingredient Composition

Zinc, together with magnesium, is precipitated in the aluminum matrix in the form of $MgZn_2$ (η-phase) or $Al_2Mg_3Zn_3$ (T-phase) to work to make an increase in the strength. Also, zinc, when the temperature is elevated for sintering, is molten to become a liquid phase and it wets the surface of the aluminum particles to eliminate the oxide layer thereon, and it is diffused into the aluminum matrix to also act to accelerate the bonding of the aluminum particles resulting from diffusion of them to each other due to such diffusion of zinc. If the content of Zn is below 3 mass %, it is difficult to sufficiently exhibit the above-described works, with the result that the effect of making the enhancement in the strength becomes poor. On the other hand, if the content is beyond 10 mass %, the amount of Zn in the sintered mass or the amount of Zn-based eutectoid liquid phase becomes excessively large, with the result that it becomes impossible to maintain the shape of compact as is. In addition, the portion where the diffusion of Zn into the Al base is insufficient remains in the form of a Zn-rich phase. Further, Zn volatilizes from inside the alloy and in consequence contaminates the interior of the furnace and is deposited there. Accordingly, the content of Zn is preferred to range from 3 to 10 mass %.

Magnesium forms the above-described precipitation compound together with zinc to contribute to enhancing the strength. Also, Mg is also low in melting point, and in the course where the temperature is elevated for performing the sintering, it produces a liquid phase to eliminate the oxide layer to work to accelerate the progress of the sintering. If the content of Mg is below 0.5 mass %, that makes the above-described effect poor, and, if it is over 5.0 mass %, that increases the amount of liquid phase to become excessively large, resulting in that it becomes impossible to maintain the shape of compact as is. Accordingly, the content of Mg is preferred to range from 0.5 to 5.0 mass %.

Copper is dissolved in the aluminum matrix to form solid solution and precipitate a compound of $CuAl_2$ (θ-phase), thereby contributing to enhancing the strength. It also generates a liquid phase, when performing the sintering step, and works to accelerate the progress of the sintering. Regarding the content of Cu, if it is below 0.5 mass %, that work is not sufficiently attained, and, if it exceeds 5.0 mass %, copper forms an unnecessary Cu—Zn alloy phase with zinc, which is precipitated large along the grain boundary to cause the decrease in the strength and elongation. Therefore, the amount of Cu is preferred to range from 0.5 to 5.0 mass %.

Tin, bismuth and indium are low in melting point and generate a liquid phase in the sintered mass, respectively. As a result, they wet the surface of the aluminum particles and eliminate the oxide layer from the surface of the aluminum particles, to accelerate the progress of the sintering between the Al powder particles without solution in aluminum. In addition, due to the surface tension of liquid phase, the liquid phases cause shrinkage, which works to contribute to densifying the resulting mass. Therefore, it would be preferable if using the above elements as a sintering auxiliary agent together with the above-described Zn, Mg and Cu. When the length of the term during which the liquid phase exists increases, the densifying attributable to the liquid phase progresses further. Therefore, if the liquid phase generates at an early stage of the sintering step so that the liquid phase continues to exist during the almost entire step of sintering, the densifying effect becomes great. In this view point, Sn (the melting point: 232° C.), Bi (the melting point: 271° C.), and In (the melting point: 155.4° C.) are very suitable, because they have a low melting point and they are hardly dissolved into the main component, Al. The sintering auxiliary agent, when added 0.01 mass % or more, exhibits a remarkable densifying effect. However, if used in large amount, Sn, Bi and In become precipitated at the grain boundary to cause the decrease in the strength, since they are not dissolved with Al. Therefore, the use of them should be limited to 0.5 mass % or less at the most. Adding in an amount of 0.5 mass % or more results in that the decrease in the strength due to the precipitation of the Sn, Bi and In at the grain boundary becomes larger in degree than the above-described effect of densification due to the shrinkage of the liquid phase, resulting in more decrease in strength.

(1)-2 Form of Powder

A. In a Case of Using a Simple Zinc Powder

Regarding the above-described Zn, Mg and Cu, no inconvenience occurs when they are added to the zinc powder, in any case of using simple element powder, alloy powder of two or more kinds of these elements, or a powdery mixture of them. However, in order to cause the above-described works uniformly in the base, it is necessary to disperse the respective ingredient elements uniformly in the matrix. For this reason, it is recommended that those ingredient elements, as later described, are added in the form of fine powder whose particle size is 200 meshes (74 microns) or less. In a case where they are added like that, the simple element powder or alloy powder is melted when the temperature is elevated during sintering and becomes a liquid phase to wet the surface of the aluminum powder to eliminate the oxide layer thereon. They are then diffused into the aluminum matrix and, in addition, accelerate the bond between the aluminum powder particles due to such diffusion.

B. In a Case of Using Aluminum Alloy Powder Containing the Whole Amount of Zinc

Zinc is an element that is likely to volatilize at a high temperature. Therefore, if Zn is added in the form of aluminum alloy powder by alloying the whole amount of Zn with aluminum, the amount of Zn that remaining through the volatilization of Zn becomes more stable than that in a case where Zn is added as simple zinc powder. As a result of this, the degree of fluctuation among the products becomes small.

However, incorporation of Zn causes a hardening in the aluminum alloy powder to decrease the compressibility of the powder. Accordingly, if Zn is made into alloy with the whole amount of aluminum, the compressibility of the raw material powder is decreased. Therefore, it is necessary to limit the use of aluminum alloy powder containing zinc to only a part of the whole powder for aluminum and blend soft aluminum powder into the aluminum alloy powder into which the whole amount of Zn is blended, in order to raise the compressibility of the raw material powder. For sufficiently achieving this purpose, the amount of used simple aluminum powder is necessary set to be 15 mass % of the whole raw material powder or more.

Regarding the aluminum alloy powder containing Zn, if it has a composition such that causes the production of an Al—Zn liquid phase at a low temperature, Zn is likely to volatilize from this Al—Zn liquid phase. Therefore, it is preferable that the aluminum alloy powder has a composition with which the production of the Al—Zn liquid phase is caused at a temperature that is as high as possible, that is, only at a temperature of the final stage of the sintering step. Moreover, if using an aluminum alloy powder containing a large amount of Zn, this causes to relatively increase the amount of simple aluminum powder with the result that Zn dispersed in the sintered aluminum alloy matrix becomes likely not to be uniform. This causes the occurrence of fluctuation in the values of the obtained mechanical properties. In view of these items, it is preferable that the content of Zn in the aluminum alloy powder be 30 mass % or less. On the other hand, if the content of Zn in the aluminum alloy powder falls below 10 mass %, the difference in zinc concentration from the simple aluminum powder becomes small, with the result that Zn comes to have difficulty of being diffused and uniform dispersion is suppressed by contraries. Accordingly, it is preferable that the content of Zn in the aluminum alloy powder be in the range of from 10 to 30 mass %.

Cu and Mg are used together with Zn, for the purpose of causing the uniform diffusion of Zn into the above-described matrix. Cu and Mg, in the process wherein the temperature is elevated during sintering, cause the production of a Cu—Zn liquid phase or Mg—Zn liquid phase together with Zn powder or Zn in the aluminum alloy powder. These liquid phases are immediately solidified by their components being absorbed into the aluminum powder or aluminum alloy powder, and liquefaction and solidification are repeated so that uniformity of the components rapidly proceeds. Moreover, the liquid phase at this time gets solidified so immediately that no problems with the volatilization of Zn arise. The elements, Cu and Mg, each of which has the above-described action may be added in the form of simple metal powder, an alloy powder of the both elements, or an alloy powder with aluminum, and no hindrance occurs in any of the above cases. When the aluminum alloy powder containing Zn simultaneously contains Cu at the content of 10 mass % or less, the above-described effect becomes more enhanced. However, if the amount of Cu added into the aluminum alloy powder exceeds 10 mass % of the aluminum powder, the temperature at which Cu produces a liquid phase together with Zn shifts to the high-temperature side, addition at more than 10 mass % is disadvantageous in terms of the uniform diffusion of the components.

Sn, Bi and In which are auxiliarily used as the sintering aid agent may be used in the form of simple metal powder. If using these elements as the main components and forming an eutectic compound which would cause the production of an eutectic liquid phase comprising those main components, its melting point is much lower than that in the case of single substance. Therefore, making into that eutectic compound is further preferable. This eutectic liquid phase may be the one that is made by combining the main component (Sn, Bi, In) and another element, or the one which is made by combining the main component and an intermetallic compound that comprises the main component and another element. Moreover, there is also a compound having a line of eutectic reaction which can be found in a part of the monotactic compounds, and it is also possible to use such a monotactic compound causing the production of a eutectic liquid phase that comprises Sn, Bi or In. As the elements which form the eutectic liquid phase like that with Sn, there are Ag, Au, Ce, Cu, La, Li, Mg, Pb, Pt, Tl, Zn and the like. As the elements which form the eutectic liquid phase like that with Bi there are Ag, Au, Ca, Cd, Ce, Co, Cu, Ga, K, Li, Mg, Mn, Na, Pb, Rh, S, Se, Sn, Te, Tl, Zn and the like. As the elements which form such a eutectic liquid phase as described above with In, there are Ag, Au, Ca, Cd, Cu, Ga, Sb, Te, Zn and the like. Although these respective groups of elements are an example of simple two-elemental or binary system, the same effect can be obtained even in a case of a three-elemental or ternary system, a four-elemental or quaternary system or more-elemental system, as long as the resulting eutectic liquid phase similarly has Sn, Bi or In as the main component and has a composition causing the production of a eutectic liquid phase that comprises the main component. However, regarding Pb and Cd of the above elements, although these elements also cause the production of a eutectic liquid phase with Sn, Bi or In, it is preferable to abstain the use of them from the standpoint of toxicity. With the above-described standpoint also being taken into consideration, as a multi-elemental system of eutectic alloy that comprises Sn, Bi or In as the main component, a lead-free solder the development of which has in recent years been urged can be preferably used. As the lead-free solder, ones of Sn—Zn system, Sn—Bi system, Sn—Zn—Bi system, Sn—Ag—Bi system or the like can be given, and lead-free solders prepared by adding to the above system a small amount of metal element such as In, Cu, Ni, Sb, Ga, Ge or the like has been proposed. A part of them has actually been put into practical use, and it is preferable to use such lead-free solders that are commercially available, since this it is easy to obtain. Regarding the powder of sintering aid agents, when each of them is added at 0.01 mass % or more of the whole amount of raw material powder, the resulting effect becomes prominent. On the other hand, since Sn, Bi and In are not dissolved in Al, they are precipitated at the grain boundary when using in large amount, to cause the decrease in the strength. Therefore, use of them should be suppressed to 0.5 mass % or less at the most. Addition in an amount of 0.5 mass % or more results in that the degree of decrease in the strength due to the precipitation of the Sn, Bi or In at the grain boundary becomes larger than the above-described effect of densification due to the shrinkage of the liquid phase, resulting in more decrease in strength.

(1)-3 Size of Powder

Regarding the respective ingredient elements, in a case where Zn, Mg or Cu is used in the form of simple metal powder, or a case where Mg and Cu are used in the form of alloy powder of both or in the form of alloy powder with aluminum, it is preferable, for uniformly diffusing the respective ingredient elements into the matrix, that each of those ingredient elements be added in the form of fine powder whose particle size is as small as 200 meshes (74 microns) or less (i.e. 200 meshes minus sieve or the powder having a particle size that passes through a comb screen of 200 meshes). The simple metal powder or alloy powder, when the temperature is elevated during sintering, is melted to become a liquid phase, which wets the surface of the aluminum powder to eliminate the oxide layer and which is diffused into the aluminum matrix and simultaneously to accelerate the bond between the aluminum powder particles due to the diffusion. However, if the particle size of the simple metal powder or alloy powder exceeds 200 meshes, local segregation takes place, and uniform diffusion of the ingredient elements is obstructed. Also, in a case where using a metal powder of low melting point, it is preferable to use a powder whose particle size is 200 meshes or less, in order that the effect of the liquid phase of low melting point can be equally exhibited.

However, if the aluminum powder or aluminum alloy powder is made a fine powder, the flowability of the raw material powder becomes inferior. Therefore, it is suitable to use a powder for aluminum whose particle size is greater than that of the above-described respective ingredient element powder. Specifically, it is preferable to use a powder for aluminum whose particle size is 100 meshes (140 microns) or less (i.e. 100 meshes minus sieve or the powder whose particle is of a size having passed through a comb screen of 100 meshes). However, when exceeding the size of 100 meshes, each ingredient element has the difficulty of being diffused up to the center of the powder, and the component comes to get segregated. Therefore, such should be avoided.

(2) Compacting Step

In this step, the raw material powder prepared from the above-described raw material powder blending step is filled into a die of a predetermined configuration, and the powder is then formed into a compact by compressing it under a compacting pressure of 200 MPa or more. As a result of this, a compact with a density ratio of 90% or more is obtained. If the compacting pressure falls below 200 MPa, the density of the compact becomes low, and, even after the compact passes through the subsequent sintering step and forging step, the pores remain 2 volume % or more. This results in failure to impart high strength and elongation. Such insufficient compacting is not preferable also for the reason that dimensional change during sintering becomes large. The higher the compacting pressure is, the higher the density of the obtained compact becomes. Therefore, high compacting pressure is preferable. When the compacting pressure is 400 MPa or more, a compact whose density ratio is 95% or more is obtained and this is suitable. However, a compacting pressure exceeding 500 MPa easily causes adhesion of the aluminum powder to the die and it is therefore undesirable.

(3) Sintering Step

If a large amount of the relevant liquid phase mentioned above is produced during sintering, the amount of shrinkage of the sintered mass becomes large, with the result that the dimensional precision becomes inferior. Moreover, since zinc contained as an ingredient is an element having a low melting point and is therefore easy to volatilize in this sintering step, the amount of zinc that is dissolved in the base to make solid solution is reduced by the volatilization, resulting in failing to accomplish a desired value of strength and elongation. Simultaneously, zinc contaminates the sintering atmosphere and, in some cases, is deposited within the furnace, resulting in raising a problem with the working environment as well. To avoid inviting such bad effects, in a case of using a simple zinc powder, it is then recommended that elevation of the temperature up to the sintering temperature be performed at a high rate. Namely, at the step of sintering the compact obtained in the above-described compacting step, it is recommended, in the course of temperature elevation from room temperature to the sintering temperature, that heating in the temperature range from at least 400 degrees C. being in the proximity of the melting point of zinc up to the sintering temperature is rapidly proceeded at the temperature-elevating rate of 10 degrees C./min or more to suppress the volatilization of the relevant ingredient elements. Incidentally, in a case where Zn is added in the form of aluminum alloy powder, as stated above, Zn becomes difficult to volatilize, and therefore that does not hold true.

Moreover, in the sintering step, sintering of the compact is developed by heating the compact at a sintering temperature of 590 to 610 degrees C. for a sintering time of 10 minutes or more, so that, while the excessive decrease in the dimensional precision due to the generation of a liquid phase is being suppressed, uniform diffusion of the ingredient element is possibly achieved. In the sintering step, it is necessary for uniform formation of solid solution with the respective ingredient elements in the Al base that the sintering temperature be settled to 590 degrees C. or more, and that the sintering time length be made 10 minutes or more. If the sintering conditions fall below those ranges, diffusion of the respective ingredients into the Al base becomes insufficient, resulting in that the strength decreases. On the other hand, if the sintering temperature exceeds 610 degrees C., the problems concerning the volatilization of Zn and the over-shrinkage due to the liquid phase become remarkable. In this case, the crystal grains also grow and become large, causing the decrease in the strength.

By the above-described sintering, the respective ingredients are each kept in the state of their being dissolved in the matrix. The sintered compact is then cooled and the cooling rate had better be high although not particularly limited. In detail, if the cooling rate is low, in the high temperature range (450 degrees C. or more) in particular, the increase in size of the crystal grains proceeds. In addition, the component over-saturated in the course of cooling sometimes gets precipitated along the grain boundary, to cause the decrease in the strength and elongation. Also, that portion where the over-saturated component has been precipitated sometimes gets absorbed into the matrix by subjecting to a subsequent heat treatment (solution treatment), to make pores that cause the deterioration in the strength and elongation. Therefore, it is better to cool in the high temperature range at a rate that is as high as possible. Particularly, in the temperature range of 450 degrees C. or more, it is preferred that the sintered compact is cooled at a rate of −10 degrees C./min.

In regard to the sintering atmosphere, non-oxidizing one is suitable. Among various non-oxidizing gases, an atmosphere of nitrogen gas wherein the dew point is made −40 degrees C. or less is the most suitable. The dew point is an indicator that indicates the amount of water in the atmosphere of gas, and a large amount of water, that substantially means a large amount of oxygen, hinders the progress of the sintering operation since the Al is likely to have a bond to oxygen, to obstruct the densification of the mass. Since nitrogen gas is also inexpensive and safe comparing to other non-oxidizing gases, the nitrogen gas atmosphere that the dew point is specified as above is therefore preferable.

In accordance with the above sintering, the ingredient elements are uniformly dissolved in the Al matrix to make solid solution through liquid phase sintering, and a sintered compact such that the density ratio is 93% or more and the pores are closed pores is possibly obtained.

(4) Forging Step Causing Plastic Flow Under Pressure

In general, it is known to possibly increase the density through the execution of the forging treatment. However, in the case of porous material, simply increasing the density only results in that the pores get closed and no metallic bond is formed at the pore walls. As a result, that is followed by the occurrence during forging of cracks in the surface of the material or the remaining the pores as the defects within the product, failing to enhance the strength and elongation. Accordingly, in order to obtain a high level of strength and elongation, it is necessary not only to close the pores but also to form metallic bond there. To obtain this metallic bond, in general, the forging has been performed through two-divided sub-steps, one of which is a sub-step for performing densification of the relevant material and the other of which is a deforming sub-step for obtaining metallic bond by deforming the densified material.

In the present invention, for the process to obtain metallic bond, there is employed a technique of performing upsetting forging that comprises applying pressure, from the above and below, to the sintered porous material that has been obtained as above, to compress it in the direction of height for closing the pores, and also to deform the compressed material toward the space provided at the lateral side of the material for causing plastic flow of the material in the direction crossing to the direction in which the pressure is applied, thereby compulsively forming material bond of the original pore portions (i.e. the portion where the pore is closed although no metallic bond is made), while metallic bond is formed in these pore portions. Accordingly, the forging step of the present invention comprises a single operation into which the works of the two sub-steps that have been conventionally executed are merged. In connection with the upsetting forging, the upsetting ratio is determined as a ratio of the difference in the pressing direction between the dimensions before and after forging of the material relative to the dimension before forging of the material. Here, it is noted that the importance of the forging step of the present invention is to cause lateral plastic flow of the material under pressure. Therefore, if the above-described upsetting deformation is main work of the operation of the forging step, that is acceptable and no hindrance exists even when the operation of the forging step also locally or partially works as forward or backward extrusion on the material. Namely, the forging operation according to the present invention can include a technique wherein the material is locally extruded. Moreover, the processing operation that the area of material is reduced by means of a die, such as forging with forward or backward extrusion and the like, can also be included in the operation of the forging step, since the pressing in that operation works in radial directions and the direction in which the material is deformed is along the extruding direction or the one that intersects the pressing directions at right angles. Therefore, the above technique of working is also included in the scope of the present invention. Also, by performing the above forging operation for the compressing and plastically material flowing works described above, it is also possible to obtain, in addition to the above-described action, an action which makes fine the crystal grain that grew during sintering, as well as breaks the precipitate, whereby the strength and elongation are more enhanced.

Accordingly, with respect to the sintered body having a density ratio of 93% or more that has been obtained at the above-described sintering step, the forging step is accomplished by subjecting a cold forging treatment wherein cold forging at room temperature is performed at an upsetting ratio of 3 to 40%, or a hot forging treatment wherein hot forging at 150 to 450 degrees C. is performed at an upsetting ratio of 3 to 70%, to obtain a sinter forged aluminum part which has an increased density ratio of 98% or more. The resultant part has a high tensile strength and elongation.

In the case of cold forging, it is necessary to forge so that the upsetting ratio is 3 to 40%. If the upsetting ratio is less than 3%, deformation occurs only locally when the diameter after the forging is the same or larger in comparison with that before the forging, with the result that the amount of residual pores is increased to fail to enhance the strength and elongation. Also, in a case where forging is done with a die whose diameter is small such as forward extrusion forging, an upsetting ratio of 3% or more is necessary for the reason described above. Incidentally, if the upsetting ratio is 10% or more, the density ratio of the forged mass can easily be made to be 98% or more. Therefore, that setting is preferable. On the other hand, if the upsetting ratio exceeds 40%, cracking is likely to occur on the forged mass. When employing the cold forging operation, if upsetting forging is designed in such a manner that the terminal end portions of the material laterally extended during forging come to full contact with the inner wall of the die at the finish of the forging operation, the precision in dimension and shape of products increases and defects have difficulty remaining on the uppermost surface. Therefore, such way of upsetting forging is preferable.

In the case of hot forging, if heating the material (sintered mass) within a range of from 100 to 450 degrees C., preferably from 200 to 400 degrees C., forging at an upsetting ratio within a range of from 3 up to 70% is allowed. When the heating temperature for the material (sintered mass) is below 100 degrees C., almost no useful change is made in comparison with the case of cold forging. That is, the deformability of the material is still poor and it is therefore difficult to raise the upsetting ratio. In a case where the heating temperature of the material (sintered mass) is 200 degrees C. or more, the material becomes soft and the deformability increases. Accordingly, it is possible to decrease the forging pressure for performing hot forging at a desired value of upsetting ratio. Therefore, such temperature range is preferable. On the other hand, if the heating temperature exceeds 450 degrees C., the adhesion between the die and the material (sintered mass) remarkably occurs. Therefore, the upper limit needs to be set at 450 degrees C. at maximum, and preferably at 400 degrees C. However, even in the suitable temperature range described above, if the upsetting ratio exceeds 70%, forging cracks become likely to occur. Also in the case of hot forging, if upsetting forging is performed in such a manner that the terminal end portions of the material laterally extended during forging come to contact with the inner wall of the die at the finish of the forging operation, defects have difficulty remaining on the uppermost surface. Therefore, such way of upsetting forging is preferable.

Regarding the sinter forged aluminum parts obtained through the above-described steps, since they are so densified that the density ratio is 98% or more and the crystal grains are made fine, they exhibit such an excellent mechanical property as a tensile strength of 300 MPa or more and an elongation of 4% or more. Moreover, it is possible to further improve the mechanical property, by an additional step for subjecting heat treatment step (T6 treatment) after the forging step.

(5) Heat-treating (T6 Treatment) Step

The heat-treating (T6 treatment in accordance with the regulation of JIS H 0001) step in the manufacturing method of the present invention comprises a solution treatment and an aging precipitation treatment. In the solution treatment, a precipitation phase in the Al base is uniformly dissolved in the Al base to form solid solution by heating at a temperature of from 460 to 490 degrees C., and the resulting mass is then water-quenched, thereby making an over-saturated solid solution. In the aging precipitation treatment, the resulting mass after the solution treatment is maintained at a temperature of from 110 to 200 degrees C. to precipitate the over-saturated solid solution and form the precipitation phase dispersed in the Al base. If the temperature for the solution treatment is below 460 degrees C., the precipitated components does not uniformly form solid solution as a whole into the Al matrix. On the other hand, if that temperature exceeds 490 degrees C., although that effect almost does not change, a liquid phase is produced at a temperature exceeding 500 degrees C., to cause the generation of pores. In regard to the aging treatment, if the temperature is below 110 degrees C., a sufficient amount of precipitated compound is not obtained, whereas, in a case where the temperature exceeds 200 degrees C., the precipitated compound grows to become excessively large, resulting in the decrease in the strength. In regard to the length of time for the aging treatment, it is preferably 1 to 28 hours. The temperature and time length can suitably be adjusted, respectively, within the above-described ranges according to the property that is required.

The aluminum-based sinter forged parts that have been obtained by performing the above-described heat treatment, as will be apparent from the following Examples, are improved to have a tensile strength of 500 MPa or more and an elongation of 3% or more, and exhibit therefore an excellent mechanical property that cannot be expected from the one in the conventional art, and that is equivalent to general steel products.

EXAMPLES

A. Examples in which Zn is Added in the Form of Simple Metal Powder

Example 1

The raw material powder blending step, the compacting step, the sintering step, the forging step, and the heat treatment step were sequentially performed to manufacture and evaluate five kinds of samples of sinter forged aluminum parts, by changing the pressure under which the powder was compacted. Specifically, in the raw material powder blending step, aluminum powder having a particle size of 100 meshes, and zinc powder, magnesium powder, copper powder and tin powder, each of which has a particle size of 250 meshes respectively, were prepared to provide a raw material powder by blending and mixing those powders together so that the ingredient composition of the blended powder was in the mass ratio of Zn: 5.5%, Mg: 2.5%, Cu: 1.5%, Sn: 0.05%, the balance Al and inevitable impurities. In the compacting step, using the above-described raw material powder and changing the compacting pressure, the raw material powder was formed under compacting pressure into a compact of columnar shape having dimensions of ϕ40 mm×28 mm. In the sintering step, the compact was heated in an atmosphere of nitrogen gas, by elevating the heating temperature within a range of from 400° C. up to sintering temperature of 600 degrees C. at a temperature-elevating rate of 10 degrees C./min, and it was sintered by keeping it at the sintering temperature for 20 minutes. After that, the compact was cooled from the sintering temperature down to 450 degrees Cat a cooling rate of −20 degrees C./20 min. In the forging step, thus obtained sintered compact was heated at 200 degrees C. to perform hot forging at an upsetting ratio of 40%. The forged compact was heated at 470 degrees C. to perform solution treatment, and it was then maintained at 130 degrees C. for 24 hours to perform aging precipitation treatment. For the evaluation of obtained samples A-01 to A-05, each of them was processed into a tensile test piece, and tensile test was conducted thereon to measure the tensile strength and elongation. The results are shown in Table 1. Moreover, while preparing the above-described samples, the density ratio was respectively measured on each of the compact after the compacting step, the sintered compact after the sintering step and the forged compact after the forging step, in each of the samples. The results also are shown together in Table 1.

TABLE 1

| Sample No. | Compacting Pressure (MPa) | Density ratio (%) Green Compact | Sintered Compact | Forged Compact | Tensile Strength (MPa) | Elongation (%) | Remarks |
|---|---|---|---|---|---|---|---|
| A-01 | 100 | 92.6 | 97.5 | — | — | — | Loose shape by Excess. shrinkage |
| A-02 | 200 | 93.6 | 97.9 | 99.3 | 523 | 4.5 | |
| A-03 | 300 | 94.3 | 98.3 | 99.4 | 505 | 4.1 | |
| A-04 | 400 | 95.0 | 98.9 | 99.6 | 520 | 4.3 | |
| A-05 | 500 | 95.2 | 98.9 | 99.6 | 525 | 4.7 | |

From the results shown in Table 1, it is seen that, if the compacting pressure is 200 MPa or more, a green compact mass whose density ratio is high is obtained, and, as a result, the product obtained by passing through the steps of sintering, forging, and heat treatment exhibits a high mechanical property to such an extent as the tensile strength is 500 MPa or more and the elongation exceeds 4%. On the other hand, in a case of sample number A-01 in which the compacting pressure is below 200 MPa, the density ratio of the green compact is low and the quantity of shrinkage due to the liquid phase generating is large, and the relevant compact thus got out of shape. For this reason, executing the succeeding forging and heat treatment steps was canceled and the test was also canceled.

Example 2

In this example, using the raw material powder prepared in Example, sintered forged aluminum parts of sample Nos. A-06 to A-16 were manufactured by performing the same operation of Example 1, excepting that the compacting pressure was settled to 200 MPa; and the sintering conditions were changed to those shown in Table 2. Regarding each of these samples, the density ratio after executing each step as well as the tensile strength and elongation was measured, the results being shown in Table 2 together with the measured results concerning the sample No. A-02 in Example 1. Here, in Table 2, the field "Temperature-Elevating Rate" shows the rate of elevating the temperature in the range from 400 degrees C. up to the sintering temperature.

TABLE 2

| Sample No. | Temperature-Elevating Rate(° C./min) | Sintering Temp. (° C.) | Time (min) | Density Ratio (%) Green Compact | Sintered Compact | Forged Compact | Tensile Strength (MPa) | Elongation (%) | Remarks |
|---|---|---|---|---|---|---|---|---|---|
| A-02 | 10 | 600 | 20 | 93.6 | 97.9 | 99.3 | 525 | 4.5 | |
| A-06 | 5 | 600 | 20 | 93.6 | 96.8 | 98.9 | 480 | 3.3 | |
| A-07 | 15 | 600 | 20 | 93.6 | 98.6 | 99.3 | 515 | 4.2 | |
| A-08 | 20 | 600 | 20 | 93.6 | 97.9 | 98.9 | 525 | 4.7 | |
| A-09 | 10 | 580 | 20 | 93.6 | 88.7 | 98.6 | 439 | 3.8 | |
| A-10 | 10 | 590 | 20 | 93.6 | 97.9 | 98.9 | 525 | 4.5 | |
| A-11 | 10 | 610 | 20 | 93.6 | 98.6 | 98.9 | 528 | 4.6 | |
| A-12 | 10 | 620 | 20 | 93.6 | — | — | — | — | Loose shape by melt |
| A-13 | 10 | 600 | 0 | 93.6 | 88.7 | 98.2 | 440 | 3.8 | |
| A-14 | 10 | 600 | 20 | 93.6 | 98.6 | 98.9 | 490 | 4.0 | |
| A-15 | 10 | 600 | 30 | 93.6 | 97.9 | 98.9 | 500 | 4.1 | |
| A-16 | 10 | 600 | 40 | 93.6 | 97.9 | 98.9 | 510 | 4.1 | |

First, comparing the sample of No. A-02 and the samples of Nos. A-06 to A-08, the effect of the temperature-elevating rate that occurs within the range from 400 degrees C. up to the sintering temperature is searched. In regard to the sample of No. A-06 in which the temperature-elevating rate is below 10 degrees C./min, the Zn component volatilized from the compact during sintering and the quantity of precipitation phase decreased. As a result of this, the obtained product exhibits a low level of tensile strength and a small value of elongation. On the other hand, regarding the samples of Nos. A-02, A-07 and A-08, in which the temperature-elevating rate is 10 degrees C./min or more, it is seen that each of them exhibits a high level of mechanical property to such as extent as the tensile strength is 500 MPa or more and the elongation is over 4%.

Second, comparing the samples of Nos. A-02 and A-09 to A-12 in Table 2, the effects of the sintering temperature. Regarding each of the samples of Nos. A-02, A-10 and A-11, in which the sintering temperature is within a range of from 590 to 610 degrees C., it is seen that that sample exhibits a high level of mechanical property to such an extent as the tensile strength is 500 MPa or more and the elongation is over 4%. On the other hand, regarding the sample of No. A-09 in which the sintering temperature is below 590 degrees C., both the tensile strength and the elongation are decreased. The reason for this is considered that the ingredient element added in the form of a simple metal powder is not completely dissolved in the Al matrix to form solid solution and is locally segregated to remain, with the result that the relevant sample has a small value of mechanical strength. Conversely, in the sample of No. A-12 in which the sintering temperature is over 610 degrees C., the compact gets out of shape due to the fact that the liquid phase generates in excess. The succeeding tests have been therefore canceled.

Third, comparing the samples of Nos. A-02 and A-13 to A-16 in Table 2, the effect of the sintering time was searched. In the sample of No. A-13 in which the sintering time is less than 10 minutes, it is low in terms of the tensile strength as well as the elongation. The reason of this is considered that, when the sintering time is short, the ingredient is not sufficiently dissolved in the Al matrix to form solid solution and it is locally segregated to remain, with the result that the relevant sample has a small value of mechanical strength. On the other hand, in the samples of Nos. A-02 and A-14 to A-16 in which the sintering time is 10 minutes or more, the ingredient is uniformly dissolved in the Al matrix to form solid solution. Therefore, the relevant samples exhibit a high level of mechanical strength to such an extent that the tensile strength is 500 MPa or more and the elongation is over 4%. However, even if the sintering time exceeds 30 minutes, the mechanical strength is not changed very much. Therefore, the setting of the sintering time being 30 minutes or less will be sufficient.

Example 3

In this example, using the raw material powder prepared in Example 1, the same operation of Example 1 was repeated, excepting that the forging conditions were changed to those shown in Table 3, to manufacture samples of sinter forged aluminum parts of Nos. A-17 to A-34 under the same conditions as those in Example 1. Regarding each of these samples, the density ratio after executing each step as well as the tensile strength and elongation was measured, the results being shown in Table 3 together with the measured results concerning the sample of No. A-02 in Example 1. Here, in Table 3, regarding the field "Forging Temperature", the term "R.T. (Room Temperature)" designates the case of cold forging, and, in the case of hot forging, the heating temperature for the sintered compact sample as a material to be forged is shown. The sample of No. A-17 is prepared for comparison with a specimen of a conventional material that is similar to the material of Japanese Patent Application National Publication No. 11-504388 (WO 96/34991) with no forging.

TABLE 3

| Sample | Forging Temperature | Upsetting | Density Ratio of Compact (%) | | | Tensile Strength | Elongation | |
|---|---|---|---|---|---|---|---|---|
| No. | (° C.) | Ratio (%) | Green | Sintered | Forged | (MPa) | (%) | Remarks |
| A-17 | No Forge | No Forge | 93.6 | 97.9 | — | 480 | 1.5 | |
| A-18 | R.T. | 3 | 93.6 | 97.9 | 98.9 | 510 | 3.0 | |
| A-19 | R.T. | 10 | 93.6 | 97.9 | 99.3 | 515 | 3.0 | |
| A-20 | R.T. | 20 | 93.6 | 97.9 | 99.3 | 520 | 3.2 | |
| A-21 | R.T. | 40 | 93.6 | 97.9 | 99.3 | 518 | 3.2 | |
| A-22 | R.T. | 45 | 93.6 | 97.9 | — | — | — | Cracks occurred |
| A-23 | 100 | 40 | 93.6 | 97.9 | 99.3 | 515 | 4.0 | |
| A-24 | 150 | 40 | 93.6 | 97.9 | 99.3 | 520 | 4.2 | |
| A-02 | 200 | 40 | 93.6 | 97.9 | 99.3 | 523 | 4.5 | |
| A-25 | 300 | 40 | 93.6 | 97.9 | 99.3 | 525 | 4.6 | |
| A-26 | 400 | 40 | 93.6 | 97.9 | 99.3 | 530 | 4.2 | |
| A-27 | 450 | 40 | 93.6 | 97.9 | 99.3 | 525 | 4.1 | |
| A-28 | 500 | 40 | 93.6 | 97.9 | 99.3 | — | — | Die galling |
| A-29 | 400 | 3 | 93.6 | 97.9 | 98.9 | 505 | 4.0 | |
| A-30 | 400 | 10 | 93.6 | 97.9 | 99.3 | 510 | 4.3 | |
| A-31 | 400 | 20 | 93.6 | 97.9 | 99.3 | 520 | 4.5 | |
| A-26 | 400 | 40 | 93.6 | 97.9 | 99.3 | 530 | 4.2 | |
| A-32 | 400 | 70 | 93.6 | 97.9 | 99.3 | 515 | 4.4 | |
| A-33 | 400 | 80 | 93.6 | 97.9 | 99.3 | — | — | Cracks occurred |

First, comparing the samples of Nos. A-17 to 22 in Table 3, the effect of the upsetting ratio that is brought about when cold forging is carried out at room temperature is searched. In this case, if the upsetting ratio is in a range from 3 to 40%, it is found that the relevant sample has the level of mechanical strength that is as high as 500 MPa or more of tensile strength and 3% or more of elongation. On the other hand, if the upsetting ratio exceeds 40%, cracks occur in the sample due to forging. The test for evaluation of the sample was therefore canceled.

Second, comparing the samples of Nos. A-02, A-21 (cold forging), and A-23 to A-28 in Table 3, the effect of the heating temperature at which hot forging was performed is searched, changing this heating temperature for every sample. As a result of this, it is found that, as stated above, the tensile strength is as high in value as 500 MPa or more, even in case of cold forging. However, performing hot forging improved the elongation to 4% or more. This is attributable to the fact that, although in the case of cold forging hair cracks very slightly remain within the sample, followed by decrease in the elongation, carrying out hot forging of the material with the heating temperature being set to 100 degrees C. or more makes the hair cracks removed. On the other hand, when the forging temperature exceeds 450 degrees C., adhesion (die galling) of the sintered compact to the die occurs. Therefore, the test in such a case has been cancelled.

Third, comparing the samples of Nos. A-29 to A-34 in Table, the effect of the upsetting ratio in a case where hot forging is performed is researched. In the case of hot forging, it is found that, even when the upsetting ratio within a wide range of 3 to 70% is employed, each of the relevant samples has a high level of mechanical property to such an extent as the tensile strength is 500 MPa or more and the elongation is 4% or more. On the other hand, when the upsetting ratio exceeds 70%, forging causes cracks in the samples. Therefore, the test in such a case has been cancelled.

Example 4

In this example, using the aluminum powder, zinc powder, magnesium powder and copper powder used in Example 1, the operation of Example 1 was repeated, excepting that, as the other raw materials, tin powder, bismuth powder, indium powder, and lead-free solder powder (Zn: 8 mass %, Bi: 3 mass %, and the balance: Sn) each of which had a particle size of 250 meshes minus sieve were prepared, that their amounts added were changed as shown in Table 4, and that the compacting pressure was settled to 200 MPa, thereby the samples of Nos. A-34 to A-41 were manufactured under the same conditions as in Example 1. Regarding each of these samples, the density ratio after executing each step as well as the tensile strength and elongation was measured, the results being shown in Table 4 together with the measured results of the sample of No. A-02 prepared in Example 1.

TABLE 4

| Sample No. | Blending Ratio (Mass %) | Low-Melting-Point Metal Powder | Density Ratio (%) Green Compact | Sintered Compact | Forged Compact | Tensile Strength (MPa) | Elongation (%) |
|---|---|---|---|---|---|---|---|
| A-34 | Zn powder: 5.4 | — | 93.6 | 90.4 | 99.3 | 490 | 3.8 |
| A-35 | Mg powder: 2.6 | Sn powder: 0.01 | 93.6 | 96.5 | 99.3 | 520 | 4.4 |
| A-02 | Cu powder: 1.5 | Sn powder: 0.05 | 93.6 | 97.9 | 99.3 | 523 | 4.5 |
| A-36 | | Sn powder: 0.1 | 93.6 | 97.9 | 99.3 | 523 | 4.5 |
| A-37 | | Sn powder: 0.5 | 93.6 | 96.1 | 99.3 | 520 | 4.0 |
| A-38 | | Sn powder: 0.7 | 93.6 | 95.8 | 99.3 | 495 | 3.1 |
| A-39 | | Bi powder: 0.05 | 93.5 | 98.0 | 99.3 | 526 | 4.4 |
| A-40 | | In powder: 0.05 | 93.6 | 97.9 | 99.3 | 515 | 4.2 |
| A-41 | | Pb-free solder powder: 0.05 | 93.6 | 98.1 | 99.3 | 525 | 4.5 |

First, comparing the samples of Nos. A-02, A-34 to A-38 in Table 4, the effect of the quantity of the low-melting-point metal powder added is searched. It is found that, when adding the low-melting-point metal, the tensile strength and elongation are improved and the mechanical property is high, as compared to the product (the sample No. A-34) having no low-melting-point metal. Also, regarding the quantity added, it is seen that, the effect of this addition becomes distinctive with the addition of 0.01 to 0.5 mass; the effect is the most outstanding when that addition exceeds 0.5 mass %; but % the decrease in the elongation is remarkable when the quantity added is 0.05 to 0.1 mass. Accordingly, regarding the addition of the low-melting-point metal powder, it is confirmed that the enhancement in the mechanical property is effectively achieved when that addition was made with a range of from 0.01 to 0.5 mass %.

Second, comparing the samples of Nos. A-02 and A-39 to A-41 in Table 4, the effect of the kind of the low-melting-point metal powder is searched by change in the kind. From the results, it was confirmed that, even when the bismuth powder, indium powder, or lead-free solder powder is used in place of the tin powder, the same effect is brought about.

B. Examples with Zn Added in the Form of Al Alloy Powder

In the sintered forged aluminum part with high strength of the present invention, there are sequentially executed the raw material powder blending step, compacting step, sintering step, and forging step. Of these steps, in Examples 5 to 8, the samples are manufactured by changing the kinds of raw materials, as well as the blending proportion of the raw material powder, namely by changing the conditions that are used when executing the raw powder blending step, and they are evaluated, the results obtained being shown. In Example 9, by changing the conditions under which the compacting step and sintering step are executed, and, in Example 10, by changing the conditions under which the forging step is executed, samples are respectively manufactured and the resulting products are evaluated to show the obtained results.

Example 5

Example 5 is an embodiment wherein the result obtained in a case where Zn is added in the form of an aluminum alloy powder and that in a case where Zn is added in the form of a simple metal powder are compared with each other.

Specifically, in the raw powder blending step, aluminum powder whose particle size was 100 meshes, aluminum alloy powder of which the content of Zn was 12 mass %, and zinc powder, magnesium powder, copper powder, and tin powder, each of which had a particle size of 250 meshes were prepared. These powders were mixed together in the blend composition shown in Table 5, to prepare the raw material powder for each of samples No. B-01 and B-02 whose ingredient composition was in the mass ratio of Zn: 5.5%, Mg: 2.5%, Cu: 1.5%, Sn: 0.1%, the balance being Al and inevitable amounts of impurities.

In the compacting step, using the above-described raw material powder, five columnar compacts each having dimensions of ϕ40 mm×28 mm, in each sample, were made respectively by pressing the powder under the compacting pressure, with appropriately adjusting the compacting pressure.

In the sintering step, these green compacts were sintered while they were heated in an atmosphere of nitrogen gas over the temperature range of from 400 degrees C. up to the sintering temperature of 600 degrees C., while the temperature was elevated at the rate of 10 degrees C./min and while they were maintained for 20 minutes at the sintering temperature. Then they were cooled over the temperature range from the sintering temperature to 450 degrees C. wherein the temperature was lowered at the rate of −20 degrees C./min. In the forging step, the sintered compact obtained like that was heated at 200 degrees C. and was hot forged at the upsetting ratio of 40%. The thus obtained forged compact was heated at 470° C. for the solution treatment, and then another heat treatment step wherein the resulting compact was maintained at 130 degrees C. for 24 hours to perform aging precipitation treatment.

And, for performing evaluation of each of the samples of Nos. B-01 and B-02 obtained, the five products of each sample were processed into five tensile test pieces and then tensile test was conducted to measure the tensile strength and elongation. The results obtained are shown in Table 6 as the average value and 3σ value. Also, during the manufacture of the above-described samples, regarding each of the compacts after executing the compacting step, the sintered compact after executing the sintering step, and the forged compact after executing the forging step, the density ratios (average values) thereof were measured, the results also being shown together in Table 6.

From the results in Tables 5 and 6, it is confirmed that the strength becomes slightly higher and that the fluctuation in terms of the strength can be particularly suppressed to a smaller range of values in a case where Zn is added in the form of the alloyed powder with Al (the sample No. B-01), than in a case where Zn is added in the form of non-blended powder (the specimen no. B-02).

Example 6

Example 6 is an embodiment of the invention wherein the comparison was made, with changing the blending proportion between the aluminum powder and the aluminum alloy powders (each having a particle size of 100 meshes) shown in Table 7 wherein the content of Zn is different. Regarding each of the aluminum powder, magnesium powder, copper powder and tin powder, the same power as in Example 5 was used respectively, and the raw material powders each having the ingredient compositions shown in Table 8 were prepared. Using each of these raw material powders, the compacting step, sintering step, forging step, heat treatment step, and sample piece processing step were executed under the same conditions as in Example 5. And, regarding each of the obtained samples, the mechanical property such as the density ratio in each step and the tensile strength and elongation of the relevant product was measured, the results being shown in Table 9 together with the measured result (average value) of the sample of No. B-01 in Example 5.

TABLE 5

| | Blending Ratio (Mass %) | | | | | | | | |
|---|---|---|---|---|---|---|---|---|---|
| Sample No. | Aluminum powder | Aluminum alloy powder | Al | Zn | Zn powder | Mg powder | Cu powder | Kind | Low-melting-point metal powder |
| B-01 | 50.0 | 45.9 | balance | 12.0 | — | 2.5 | 1.5 | Sn powder | 0.1 |
| B-02 | 90.4 | — | | | 5.5 | 2.5 | 1.5 | Sn powder | 0.1 |

TABLE 6

| | Density Ratio (%) | | | Evaluation | | | | |
|---|---|---|---|---|---|---|---|---|
| | | | | Tensile Strength (MPa) | | Elongation (%) | | |
| Sample No. | Green Compact | Sintered Compact | Forged Compact | Average | 3σ | Average | 3σ | Remarks |
| B-01 | 87.0 | 93.0 | 99.3 | 530 | 15 | 4.1 | 1.8 | |
| B-02 | 93.6 | 97.9 | 99.3 | 523 | 33 | 4.5 | 1.6 | Same as A-02 in Example 1 |

TABLE 7

| Sample No. | Blending Ratio (Mass %) | | | | | | | |
|---|---|---|---|---|---|---|---|---|
| | Al powder | Al alloy powder | Al | Zn | Mg powder | Cu powder | Kind | Low-melting-point metal powder |
| B-03 | — | 95.9 | Balance | 12.0 | 2.5 | 1.5 | Sn powder | 0.1 |
| B-04 | 5.0 | 90.9 | Balance | 12.0 | 2.5 | 1.5 | Sn powder | 0.1 |
| B-05 | 15.0 | 80.9 | Balance | 12.0 | 2.5 | 1.5 | Sn powder | 0.1 |
| B-06 | 30.0 | 65.9 | Balance | 12.0 | 2.5 | 1.5 | Sn powder | 0.1 |
| B-01 | 50.0 | 45.9 | Balance | 12.0 | 2.5 | 1.5 | Sn powder | 0.1 |
| B-07 | 70.0 | 25.9 | Balance | 12.0 | 2.5 | 1.5 | Sn powder | 0.1 |
| B-08 | 80.0 | 15.9 | Balance | 12.0 | 2.5 | 1.5 | Sn powder | 0.1 |
| B-09 | 22.5 | 73.4 | Balance | 7.5 | 2.5 | 1.5 | Sn powder | 0.1 |
| B-10 | 40.8 | 55.1 | Balance | 10.0 | 2.5 | 1.5 | Sn powder | 0.1 |
| B-01 | 50.0 | 45.9 | Balance | 12.0 | 2.5 | 1.5 | Sn powder | 0.1 |
| B-11 | 59.2 | 36.7 | Balance | 15.0 | 2.5 | 1.5 | Sn powder | 0.1 |
| B-12 | 68.3 | 27.6 | Balance | 20.0 | 2.5 | 1.5 | Sn powder | 0.1 |
| B-13 | 77.5 | 18.4 | Balance | 30.0 | 2.5 | 1.5 | Sn powder | 0.1 |
| B-14 | 82.1 | 13.8 | Balance | 40.0 | 2.5 | 1.5 | Sn powder | 0.1 |
| B-15 | 65.9 | 30 | Balance | 10.0 | 2.5 | 1.5 | Sn powder | 0.1 |
| B-16 | 62.5 | 33.4 | Balance | 30.0 | 2.5 | 1.5 | Sn powder | 0.1 |

TABLE 8

| Sample No. | Ingredient Composition (Mass %) | | | | | |
|---|---|---|---|---|---|---|
| | Al | Zn | Mg | Cu | Kind | Others |
| B-03 | Balance | 11.5 | 2.5 | 1.5 | Sn | 0.1 |
| B-04 | Balance | 10.9 | 2.5 | 1.5 | Sn | 0.1 |
| B-05 | Balance | 9.7 | 2.5 | 1.5 | Sn | 0.1 |
| B-06 | Balance | 7.9 | 2.5 | 1.5 | Sn | 0.1 |
| B-01 | Balance | 5.5 | 2.5 | 1.5 | Sn | 0.1 |
| B-07 | Balance | 3.1 | 2.5 | 1.5 | Sn | 0.1 |
| B-08 | Balance | 1.9 | 2.5 | 1.5 | Sn | 0.1 |
| B-09 | Balance | 5.5 | 2.5 | 1.5 | Sn | 0.1 |
| B-10 | Balance | 5.5 | 2.5 | 1.5 | Sn | 0.1 |
| B-01 | Balance | 5.5 | 2.5 | 1.5 | Sn | 0.1 |
| B-11 | Balance | 5.5 | 2.5 | 1.5 | Sn | 0.1 |
| B-12 | Balance | 5.5 | 2.5 | 1.5 | Sn | 0.1 |
| B-13 | Balance | 5.5 | 2.5 | 1.5 | Sn | 0.1 |
| B-14 | Balance | 5.5 | 2.5 | 1.5 | Sn | 0.1 |
| B-15 | Balance | 3.0 | 2.5 | 1.5 | Sn | 0.1 |
| B-16 | Balance | 10.0 | 2.5 | 1.5 | Sn | 0.1 |

TABLE 9

| Sample No. | Density Ratio of Compact (%) | | | Evaluation | | Remarks |
|---|---|---|---|---|---|---|
| | Green | Sintered | Forged | Tensile Strength (MPa) | Elongation (%) | |
| B-03 | 72.6 | — | — | — | — | sintered with large deform. |
| B-04 | 75.3 | — | — | — | — | sintered with large deform. |
| B-05 | 80.1 | 90.7 | 99.3 | 516 | 2.4 | |
| B-06 | 83.0 | 90.6 | 99.3 | 518 | 3.1 | |
| B-01 | 87.0 | 93.0 | 99.3 | 530 | 4.1 | |
| B-07 | 90.3 | 94.2 | 99.4 | 521 | 4.2 | |
| B-08 | 92.1 | 94.2 | 99.3 | 481 | 4.6 | |
| B-09 | 77.3 | 87.6 | 99.3 | 516 | 1.9 | |
| B-10 | 82.6 | 92.3 | 99.3 | 528 | 3.8 | |
| B-01 | 87.0 | 93.0 | 99.3 | 530 | 4.1 | |
| B-11 | 88.8 | 93.0 | 99.3 | 525 | 3.6 | |
| B-12 | 90.2 | 94.1 | 99.3 | 518 | 3.1 | |
| B-13 | 92.1 | 93.8 | 99.3 | 506 | 2.6 | |
| B-14 | 93.3 | 90.2 | 99.3 | 431 | 1.9 | |
| B-15 | 90.3 | 94.2 | 99.3 | 520 | 4.1 | |
| B-16 | 80.0 | 90.5 | 99.3 | 514 | 2.3 | |

Comparing the samples of Nos. B-01 and B-03 to B-08 in Tables 7 to 9, the effect of the amount of aluminum powder added is searched. In case of the products (samples of Nos. B-03 and B-04) wherein the amount of aluminum powder added is below 15 mass %, as a result of the fact that the amount of Zn in the overall composition of the raw material powder becomes excessively large to such an extent as it exceeds 10 mass %, the sintered compact is largely deformed due to the liquid phase occurring from inside the aluminum alloy powder. The subsequent steps have therefore been canceled. From the above-mentioned results, it is confirmed that, in a case where Zn is wholly added in the form of aluminum alloy powder, it is necessary to simultaneously use the aluminum powder of 15 mass % or more. On the other hand, when the amount of aluminum powder added is over 15 mass % and up to 70 mass %, the sample exhibits a high level of tensile strength and, at the same time, the relevant sample also tends to exhibit an enhanced value of elongation as the amount of aluminum powder increases. However, in the sample of No. B-08, wherein the amount of aluminum powder added is 80 mass %, the amount of Zn in the overall composition of the raw material powder falls below 3 mass % and becomes deficient, with the result that the decrease in the strength of the relevant sample is seen.

By comparing the samples of Nos. B-01 and B-09 to B-14 in Tables 7 to 9, the effect of the content of Zn in the aluminum alloy powder is searched. In these comparisons, the amount of Zn in the overall composition of the raw material powder in each sample has been adjusted to a fixed value. From the results of these samples, it is found that, in the sample of No. B-09, wherein the content of Zn in the aluminum alloy powder is below 10 mass %, the product exhibits a high value of tensile strength whereas the elongation value thereof is small. On the other hand, in a case where the content of Zn in the aluminum alloy powder is 10 mass % or more, it is found that not only does the relevant sample exhibit a high tensile strength but is the value of elongation also enhanced. However, when the content of Zn in the aluminum alloy powder exceeds 30 mass %, both the decrease in the tensile strength and the decrease in the elongation are seen to occur. Accordingly, it is confirmed that, when the amount of Zn in the aluminum alloy powder is in the range of from 10 to 30 mass %, the relevant sample exhibits high values of tensile strength and elongation.

In the optimum range confirmed as above of Zn content in the aluminum alloy powder, the lower limit value of Zn in the overall composition of the raw material powder, and the upper limit value thereof, can be searched, respectively, by the sample No. B-15 and the sample No. B-16. As a result, it is confirmed that, when the amount of Zn is in the range of from 3 to 10 mass % in the overall composition of the raw material powder, Zn works to exhibit a high tensile strength and high elongation together with the above-described effect.

Example 7

Example 7 is an embodiment wherein examination has been performed of the amounts of Mg and Cu added and the forms in which Mg and Cu were added. In this example, together with the aluminum powder, aluminum alloy powder, magnesium powder, copper powder and tin powder used for the sample No. B-01, mixed together were the aluminum alloy powders each having a composition shown in Table 6 and a particle size of 100 meshes and the aluminum-magnesium alloy powder wherein the content of Mg was 50 mass %, the balance being Al and inevitable impurities and the particle size was 250 meshes. The blending proportion is shown in Table 10, and the raw material powders each having an overall composition shown in Table 11 were prepared. Using these raw material powders, there were executed the compacting step, sintering step, forging step, heat-treating step and test piece processing step, under the same conditions as those in Example 5. Regarding the samples of Nos. B-17 to B-32 that were obtained above, the density ratios in each step as well as the mechanical properties, namely, tensile strength and elongation, were measured, the results being shown in Table 12 together with the measured result (average value) of the sample No. B-01 in Example 5.

TABLE 11

| Sample | Ingredient Composition Mass % | | | | | |
|---|---|---|---|---|---|---|
| No. | Al | Zn | Mg | Cu | Kind | Others |
| B-17 | Balance | 5.5 | 0.0 | 1.5 | Sn | 0.1 |
| B-18 | Balance | 5.5 | 0.5 | 1.5 | Sn | 0.1 |
| B-19 | Balance | 5.5 | 1.0 | 1.5 | Sn | 0.1 |
| B-01 | Balance | 5.5 | 2.5 | 1.5 | Sn | 0.1 |
| B-20 | Balance | 5.5 | 2.5 | 1.5 | Sn | 0.1 |
| B-21 | Balance | 5.5 | 5.0 | 1.5 | Sn | 0.1 |
| B-22 | Balance | 5.5 | 8.0 | 1.5 | Sn | 0.1 |
| B-23 | Balance | 5.5 | 2.5 | 0.0 | Sn | 0.1 |
| B-24 | Balance | 5.5 | 2.5 | 0.5 | Sn | 0.1 |
| B-01 | Balance | 5.5 | 2.5 | 1.5 | Sn | 0.1 |
| B-25 | Balance | 5.5 | 2.5 | 2.5 | Sn | 0.1 |
| B-26 | Balance | 5.5 | 2.5 | 5.0 | Sn | 0.1 |
| B-27 | Balance | 5.5 | 2.5 | 8.0 | Sn | 0.1 |
| B-28 | Balance | 4.4 | 2.5 | 0.7 | Sn | 0.1 |
| B-29 | Balance | 4.4 | 2.5 | 1.8 | Sn | 0.1 |
| B-30 | Balance | 4.4 | 2.5 | 2.9 | Sn | 0.1 |
| B-31 | Balance | 4.4 | 2.5 | 3.6 | Sn | 0.1 |
| B-32 | Balance | 4.4 | 2.5 | 5.5 | Sn | 0.1 |

TABLE 12

| Sample | Density Ratio of Compact(%) | | | Evaluation | | |
|---|---|---|---|---|---|---|
| | | | | Tensile Strength | Elon-gation | |
| No. | Green | Sintered | Forged | (MPa) | (%) | Remarks |
| B-17 | 88.6 | 89.1 | 99.3 | 400 | 1.1 | |
| B-18 | 88.2 | 90.6 | 99.3 | 501 | 2.6 | |
| B-19 | 87.9 | 91.1 | 99.3 | 520 | 3.2 | |
| B-01 | 87.0 | 93.0 | 99.3 | 530 | 4.1 | |
| B-20 | 87.0 | 93.5 | 99.5 | 525 | 3.8 | |
| B-21 | 86.1 | 92.8 | 99.3 | 518 | 2.1 | |
| B-22 | 86.1 | — | — | — | — | sintered with large deform. |
| B-23 | 88.6 | 92.1 | 99.3 | 421 | 4.6 | |

TABLE 10

| Sample No. | Blending Ratio (Mass %) | | | | | | | | | |
|---|---|---|---|---|---|---|---|---|---|---|
| | Al powder | Al alloy powder | Al | Zn | Mg | Cu | Mg powder | Al-50 Mg powder | Cu powder | Low-melting-point metal powder |
| B-17 | 52.5 | 45.9 | balance | 12.0 | | | | | 1.5 | Sn powder: 0.1 |
| B-18 | 52.0 | 45.9 | balance | 12.0 | | | 0.5 | | 1.5 | Sn powder: 0.1 |
| B-19 | 51.5 | 45.9 | balance | 12.0 | | | 1.0 | | 1.5 | Sn powder: 0.1 |
| B-01 | 50.0 | 45.9 | balance | 12.0 | | | 2.5 | | 1.5 | Sn powder: 0.1 |
| B-20 | 47.5 | 45.9 | balance | 12.0 | | | | 5.0 | 1.5 | Sn powder: 0.1 |
| B-21 | 47.5 | 45.9 | balance | 12.0 | | | 5.0 | | 1.5 | Sn powder: 0.1 |
| B-22 | 44.5 | 45.9 | balance | 12.0 | | | 8.0 | | 1.5 | Sn powder: 0.1 |
| B-23 | 51.5 | 45.9 | balance | 12.0 | | | 2.5 | | 1.5 | Sn powder: 0.1 |
| B-24 | 51.0 | 45.9 | balance | 12.0 | | | 2.5 | | 1.5 | Sn powder: 0.1 |
| B-01 | 50.0 | 45.9 | balance | 12.0 | | | 2.5 | | 1.5 | Sn powder: 0.1 |
| B-25 | 49.0 | 45.9 | balance | 12.0 | | | 2.5 | | 1.5 | Sn powder: 0.1 |
| B-26 | 46.5 | 45.9 | balance | 12.0 | | | 2.5 | | 1.5 | Sn powder: 0.1 |
| B-27 | 43.5 | 45.9 | balance | 12.0 | | | 2.5 | | 1.5 | Sn powder: 0.1 |
| B-28 | 61.0 | 36.4 | Balance | 12.0 | | 2.0 | 2.5 | | | Sn powder: 0.1 |
| B-29 | 61.0 | 36.4 | balance | 12.0 | | 5.0 | 2.5 | | | Sn powder: 0.1 |
| B-30 | 61.0 | 36.4 | balance | 12.0 | | 8.0 | 2.5 | | | Sn powder: 0.1 |
| B-31 | 61.0 | 36.4 | balance | 12.0 | | 10.0 | 2.5 | | | Sn powder: 0.1 |
| B-32 | 61.0 | 36.4 | balance | 12.0 | | 15.0 | 2.5 | | | Sn powder: 0.1 |

TABLE 12-continued

| Sample No. | Density Ratio of Compact(%) Green | Sintered | Forged | Evaluation Tensile Strength (MPa) | Elongation (%) | Remarks |
|---|---|---|---|---|---|---|
| B-24 | 87.8 | 93.0 | 99.3 | 501 | 4.2 | |
| B-01 | 87.0 | 93.0 | 99.3 | 530 | 4.1 | |
| B-25 | 86.6 | 93.4 | 99.3 | 520 | 2.1 | |
| B-26 | 86.1 | 93.8 | 99.3 | 513 | 1.9 | |
| B-27 | 84.1 | — | — | — | — | sintered with large deform. |
| B-28 | 87.6 | 92.1 | 99.3 | 531 | 3.2 | |
| B-29 | 88.1 | 93.0 | 99.3 | 541 | 3.6 | |
| B-30 | 88.0 | 93.6 | 99.3 | 435 | 3.8 | |
| B-31 | 87.9 | 92.8 | 99.3 | 521 | 2.6 | |
| B-32 | 87.8 | 89.6 | 99.3 | 470 | 1.3 | |

By comparing the samples of Nos. B-01, B-17 to B-19 and B-21 and B-22 in Tables 10 to 12, the effect of the amount of Mg powder that is added in the form of a simple metal powder is searched. From the results, it is found that, in the case of the Mg being not added whatsoever (the sample No. B-17), where the liquid phase that Mg would otherwise participate in does not occur, both the tensile strength and the elongation are reduced. In contrast, in a case where Mg is added in the form of a simple metal powder, the elongation as well as the tensile strength is enhanced when the amount of Mg is 0.5 mass % or more. However, in the case of sample No. B-22 wherein the amount of Mg exceeds 5 mass %, the amount of liquid phase occurring becomes excessively large, with the result that the sintered compact is deformed. From these items of finding, it is confirmed that, regarding the amount of Mg in the overall composition of the raw material powder, there is the effect of enhancing the elongation as well as the tensile strength when the amount of Mg is in the range of from 0.5 to 5 mass %.

Sample No. B-20 is an example wherein Mg is added in the form of aluminum-magnesium alloy powder. Comparing it with the sample of No. B-01, it is found that, if the amount of Mg is equal in the overall composition of the raw powder, the equivalent values of tensile strength and elongation are obtained even when Mg is added in the form of aluminum-magnesium alloy powder.

By comparing the samples of Nos. B-01 and B-23 to B-27 in Tables 10 to 12, the effect of the amount of Cu powder that is added in the form of a simple metal powder is searched. From the results, it is found that, in the case of the Cu being not added whatsoever (sample No. B-23), wherein the liquid phase that Cu would otherwise participate in does not occur, the tensile strength has a low value. In contrast, in a case where Cu is added in the form of a simple metal powder, the tensile strength is enhanced when the amount of Cu is 0.5 mass % or more. However, in the case of sample No. B-22 wherein the amount of Cu exceeds 5 mass %, the amount of liquid phase occurring becomes excessively large, with the result that the sintered compact is deformed. On the other hand, regarding the elongation, as the amount of Cu increases, the elongation tends to decrease, and, when the amount of Cu exceeds 2.5 mass %, the decrease in the elongation becomes prominent. From these items of finding, it is confirmed that, regarding the amount of Cu in the overall composition of the raw material powder, there is the effect of enhancing the tensile strength when the amount of Cu is in the range of from 0.5 to 5 mass %, and the amount of Cu in the range of from 0.5 to 2.5 mass % is preferable, because the elongation less tends to decrease.

By comparing the samples of Nos. B-28 to 32 in Tables 10 to 12, the effect of the amount of Cu in a case where Cu is added in the form of an aluminum alloy powder containing Zn therein is searched. In this case, as in the case where Cu is added in the form of a simple metal powder, the enhancement in the elongation as well as that in the tensile strength is seen more that the product wherein Cu is not added at all (the sample No. B-23). However, regarding the amount of Cu in the overall composition of the raw material powder, even when it falls within the range of from 0.5 to 5 mass % that has been confirmed above, it is seen that, if the amount of Cu in the aluminum alloy powder exceeds 10 mass %, the tensile strength and elongation become contrarily decreased. From this result, it is further confirmed that, in a case where Cu is added in a form wherein it is alloyed with the aluminum alloy powder containing Zn therein, the upper limit of Cu in the alloy needed to be 10 mass %.

Example 8

Example 8 is an embodiment wherein examination has been performed of the amounts of sintering aid powder and the kind thereof. Together with the aluminum powder, aluminum alloy powder, magnesium powder, copper powder and tin powder of the Example 5, used were the bismuth powder, indium powder and the lead-free solder powder each having a particle size of 250 meshes, and the lead-free solder powder had a composition wherein the content of Zn was 8 mass % and the amount of Bi was 3 mass %, the balance being Sn and inevitable impurities. These powders were mixed together in the proportion for blending shown in Table 13, to prepare raw material powders each having an overall composition shown in Table 14. Using these raw material powders, there were executed the compacting step, sintering step, forging step, heat-treating step and test piece processing step, under the same conditions as those in Example 5, to obtain the products of sample Nos. B-33 to B-40. Regarding the obtained samples, measurement of the density ratios in each step as well as the mechanical properties that are tensile strength and elongation was carried out, the results being shown in Table 15 together with the measured result (average value) of the sample No. B-01 in Example 5.

TABLE 13

| Sample No. | Blending Ratio (Mass %) Al powder | Al alloy powder | Al | Zn | Mg powder | Cu powder | kind | Low-melting-point metal powder |
|---|---|---|---|---|---|---|---|---|
| B-33 | 50.0 | 46.0 | Balance | 12.0 | 2.5 | 1.5 | | |
| B-34 | 50.0 | 45.99 | Balance | 12.0 | 2.5 | 1.5 | Sn powder | 0.01 |
| B-35 | 50.0 | 45.99 | Balance | 12.0 | 2.5 | 1.5 | Sn powder | 0.05 |
| B-01 | 50.0 | 45.9 | Balance | 12.0 | 2.5 | 1.5 | Sn powder | 0.1 |

TABLE 13-continued

| Sample No. | Blending Ratio (Mass %) Al powder | Al alloy powder | Al | Zn | Mg powder | Cu powder | kind | Low-melting-point metal powder |
|---|---|---|---|---|---|---|---|---|
| B-36 | 50.0 | 45.5 | Balance | 12.0 | 2.5 | 1.5 | Sn powder | 0.5 |
| B-37 | 50.0 | 45.3 | Balance | 12.0 | 2.5 | 1.5 | Sn powder | 0.7 |
| B-01 | 50.0 | 45.9 | Balance | 12.0 | 2.5 | 1.5 | Sn powder | 0.1 |
| B-38 | 50.0 | 45.9 | Balance | 12.0 | 2.5 | 1.5 | Bi powder | 0.1 |
| B-39 | 50.0 | 45.9 | Balance | 12.0 | 2.5 | 1.5 | In powder | 0.1 |
| B-40 | 50.0 | 45.9 | Balance | 12.0 | 2.5 | 1.5 | Sn—8Zn—3Bi powder | 0.1 |

TABLE 14

| Sample No. | Ingredient Composition Mass % Al | Zn | Mg | Cu | Kind | Others |
|---|---|---|---|---|---|---|
| B-33 | Balance | 5.5 | 2.5 | 1.5 | | |
| B-34 | Balance | 5.5 | 2.5 | 1.5 | Sn | 0.01 |
| B-35 | Balance | 5.5 | 5.0 | 1.5 | Sn | 0.05 |
| B-01 | Balance | 5.5 | 8.0 | 1.5 | Sn | 0.1 |
| B-36 | Balance | 5.5 | 2.5 | 1.5 | Sn | 0.5 |
| B-37 | Balance | 5.4 | 2.5 | 1.5 | Sn | 0.7 |
| B-01 | Balance | 5.5 | 2.5 | 1.5 | Sn | 0.1 |
| B-38 | Balance | 5.5 | 2.5 | 1.5 | Bi | 0.1 |
| B-39 | Balance | 5.5 | 2.5 | 1.5 | In | 0.1 |
| B-40 | Balance | 5.5 | 2.5 | 1.5 | Sn | 0.1 |
| | | | | | Bi | 0.003 |

TABLE 15

| Sample No. | Density Ratio of Compact (%) Green | Sintered | Forged | Evaluation Tensile Strength (MPa) | Elongation (%) | Remarks |
|---|---|---|---|---|---|---|
| B-33 | 87.0 | 90.1 | 99.3 | 521 | 2.6 | |
| B-34 | 87.0 | 90.1 | 99.3 | 533 | 3.6 | |
| B-35 | 87.0 | 93.1 | 99.3 | 538 | 3.9 | |
| B-01 | 87.0 | 93.0 | 99.3 | 530 | 4.1 | |
| B-36 | 87.0 | 93.2 | 99.5 | 528 | 3.3 | |
| B-37 | 87.0 | — | — | — | — | Blowout on surface of sinter. mass |
| B-01 | 87.0 | 93.3 | 99.3 | 530 | 4.1 | |
| B-38 | 87.0 | 93.3 | 99.3 | 525 | 3.8 | |
| B-39 | 87.0 | 93.0 | 99.3 | 515 | 2.6 | |
| B-40 | 87.0 | 93.0 | 99.3 | 532 | 3.6 | |

Here, comparing the samples of Nos. B-01 and B-33 to 37 in Tables 13 to 15, the effect of the amount of the low-melting-point metal powder. Comparing with the product (sample No. B-33) wherein no low-melting-point metal is added, it is found that, when the low-melting-point metal is added, the tensile strength and elongation are improved and high mechanical property is exhibited. It is also found that, regarding that amount of addition, the effect of that is seen when that is in the range of from 0.01 to 0.5 mass %; and the effect is the highest when the adding amount thereof is in the range of from 0.05 to 0.1 mass %. However, if the adding amount thereof exceeds 0.5 mass %, the decrease in the elongation is outstanding. Accordingly, it is confirmed that, regarding the addition of the low-melting-point metal powder, the effect of enhancing the mechanical properties is brought about when that addition is in the range of from 0.01 to 0.05 mass %.

Also, Comparing the samples of Nos. B-01 and B-38 to B-40 in Tables 13 to 15, wherein the kind of the low-melting-point metal powder is changed, the effect of the kind of the low-melting-point metal powder is searched. From the results of them, it is confirmed that the same effect as described above is obtained even when the bismuth powder, indium powder or lead-free solder powder is used in place of tin powder.

Example 9

Example 9 is an embodiment wherein examination is performed on a case where the compacting pressure is changed as a compacting condition, or one of the sintering temperature and sintering time is changed as a sintering condition.

Using the raw material powder which was prepared by using aluminum powder, aluminum alloy powder, magnesium powder, copper powder and tin powder and by adjusting to the same ingredient composition as that in Example 5, there were executed the compacting step and sintering step with the use of the compacting pressure, sintering temperature and sintering time shown in Table 16. Then, under the same conditions as those in Example 5, the forging step, heat-treating step and test piece processing step were performed. Regarding each of the obtained products, measurement of the density ratio in each step and the mechanical properties, i.e. tensile strength and elongation was carried out. The results are shown in Table 17 together with the result (average value) of sample No. B-01 in Example 5.

TABLE 16

| Sample No. | Compacting Conditions: Compacting Pressure (MPa) | Sintering Conditions: Sintering Temperature (° C.) | Sintering Time (min) |
|---|---|---|---|
| B-41 | 100 | 600 | 20 |
| B-42 | 200 | 600 | 20 |
| B-01 | 300 | 600 | 20 |
| B-43 | 400 | 600 | 20 |
| B-44 | 500 | 600 | 20 |
| B-45 | 300 | 550 | 20 |
| B-46 | 300 | 580 | 20 |
| B-01 | 300 | 600 | 20 |
| B-47 | 300 | 610 | 20 |
| B-48 | 300 | 620 | 20 |
| B-49 | 300 | 600 | 0 |
| B-50 | 300 | 600 | 10 |
| B-01 | 300 | 600 | 20 |
| B-51 | 300 | 600 | 30 |
| B-52 | 300 | 600 | 40 |

TABLE 17

| Sample No. | Density Ratio of Compact (%) Green | Sintered | Forged | Evaluation Tensile Strength (MPa) | Elongation (%) | Remarks |
|---|---|---|---|---|---|---|
| B-41 | 80.0 | 89.0 | — | — | — | Deformed by sintering |
| B-42 | 85.5 | 90.2 | 99.3 | 525 | 3.6 | |
| B-01 | 87.0 | 93.1 | 99.3 | 530 | 4.1 | |
| B-43 | 92.5 | 93.8 | 99.3 | 527 | 3.7 | |
| B-44 | — | — | — | — | — | Die galling |
| B-45 | 87.0 | 88.0 | 99.3 | 418 | 1.8 | |
| B-46 | 87.0 | 92.5 | 99.4 | 500 | 3.2 | |
| B-01 | 87.0 | 93.0 | 99.3 | 530 | 4.1 | |
| B-47 | 87.0 | 93.3 | 99.3 | 532 | 3.7 | |
| B-48 | 87.0 | — | — | — | — | Fusion and Deform. by sintering |
| B-49 | 87.0 | 90.1 | 99.3 | 420 | 2.0 | |
| B-50 | 87.0 | 93.0 | 99.3 | 520 | 3.4 | |
| B-01 | 87.0 | 93.0 | 99.3 | 530 | 4.1 | |
| B-51 | 87.0 | 93.0 | 99.3 | 525 | 3.9 | |
| B-52 | 87.0 | 93.0 | 99.3 | 525 | 3.6 | |

From the results of samples of Nos. B-01 and B-41 to B-44 in Tables 16 and 17, it is found that, when the compacting pressure is in the range of from 200 to 400 MPa, a compacted compact sample in which the density ratio thereof is 90% or more, and that, by passing through the sintering-forging-heat treating steps, the product of the relevant sample exhibits a high level of tensile strength and a high value of elongation. Moreover, in the sample of No. B-41 wherein the compacting pressure is below 200 MPa, the amount of shrinkage due to the occurrence of the liquid phase is large, because the density of the green compact is low. This has caused to lose the shape. As a result of this, the succeeding forging and heat-treating steps have been canceled and the relevant test has also been stopped. On the other hand, if the compacting pressure exceeds 400 MPa, die galling occurs, whereby the succeeding sintering step and the steps thereafter have been canceled and the test has been stopped.

Moreover, comparing the samples of Nos. B-01 and B-45 to B-48 in Tables 16 and 17, the effect of the sintering temperature is searched. From those results, it is found that the samples of Nos. B-01, B-46 and B-47 wherein the sintering temperature is in the range of from 580 to 610 degrees C. exhibit a high level of tensile strength and a high value of elongation. On the other hand, in the sample of No. B-45 wherein the sintering temperature is lower than 580 degrees C., both of the tensile strength and elongation are deteriorated. This is considered, because the ingredient element is not completely be dissolved in the Al matrix to form solid solution and it is locally segregated to remain, with the result that the mechanical properties deteriorate to a low value. Contrary to the above, in the sample of No. B-48 wherein the sintering temperature is higher than 610 degrees C., the sintered compact is deformed with fusion, because the amount of liquid phase excessively occurred. The succeeding test has been therefore canceled.

Comparing the samples of Nos. B-01 and B-49 to B-52 in Tables 16 and 17, the effect of the sintering time is searched. From the results of those, it is found that, in the sample of No. B-49 wherein the sintering time is shorter than 10 minutes, both of the tensile strength and elongation are deteriorated. This is considered because the ingredient element is not sufficiently dissolved in the Al matrix to form solid solution and it is locally segregated to remain, with the result that the mechanical properties come to a low value. Opposite to the above, in the samples of Nos. B-01 and B-50 to B-52 wherein the length of sintering time is longer than 10 minutes, the ingredient is evenly dissolved in the Al matrix to form solid solution, whereby the relevant product exhibits a high level of mechanical property that, while the tensile strength is 500 MPa or more, the elongation exceeds 4%. Here, it is noted that, even when the sintering time exceeds 30 minutes, the mechanical property that the product exhibits has no change. Therefore, a sintering time of 30 min or less can be regarded as being sufficient.

Example 10

In Example 10, the operation of Example 5 was repeated under the same conditions for sample production as those in Example 5, excepting that the forging conditions were changed to those shown in Table 18, to prepare product samples of Nos. B-53 to B-69, using the aluminum powder, aluminum alloy powder, copper powder and tin powder used for the Sample No. B-1 in Example 5 and preparing the raw material powders that were adjusted to the same ingredient composition as that in Example 5. Regarding each of these samples, the density ratio after executing each step as well as the tensile strength and elongation was measured, the results being shown in Table 18 together with the measured results concerning the sample No. B-01 in Example 5. Here, in Table 18, regarding the field "Forging Temperature", the term "R.T. (Room Temperature)" designates the case of cold forging, and, in the case of hot forging, the heating temperature for a sintered compact sample as a material to be forged is shown. The sample of No. B-53 is prepared for comparison with a specimen of a conventional material that is similar to the material of Japanese Patent Application National Publication No. 11-504388 (WO 96/34991) with no forging.

TABLE 18

| Sample No. | Forging Temperature (° C.) | Upsetting Ratio (%) | Density Ratio of Compact (%) Green | Sintered | Forged | Tensile Strength (MPa) | Elongation (%) | Remarks |
|---|---|---|---|---|---|---|---|---|
| B-53 | No Forge | No Forge | 87.0 | 93.0 | 99.3 | 420 | 0.5 | |
| B-54 | R.T. | 3 | 87.0 | 93.0 | 99.3 | 480 | 2.0 | |
| B-55 | R.T. | 10 | 87.0 | 93.0 | 99.3 | 485 | 2.2 | |
| B-56 | R.T. | 20 | 87.0 | 93.0 | 99.3 | 490 | 2.2 | |
| B-57 | R.T. | 40 | 87.0 | 93.0 | 99.3 | 495 | 2.3 | |
| B-58 | R.T. | 45 | 87.0 | 93.0 | — | — | — | Cracks occurred |
| B-59 | 100 | 40 | 87.0 | 93.0 | 99.3 | 510 | 2.7 | |
| B-60 | 150 | 40 | 87.0 | 93.0 | 99.3 | 515 | 3.1 | |

TABLE 18-continued

| Sample No. | Forging Temperature (° C.) | Upsetting Ratio (%) | Density Ratio of Compact (%) Green | Sintered | Forged | Tensile Strength (MPa) | Elongation (%) | Remarks |
|---|---|---|---|---|---|---|---|---|
| B-61 | 200 | 40 | 87.0 | 93.0 | 99.3 | 520 | 3.4 | |
| B-62 | 300 | 40 | 87.0 | 93.0 | 99.3 | 525 | 3.6 | |
| B-01 | 400 | 40 | 87.0 | 93.0 | 99.3 | 530 | 4.1 | |
| B-63 | 450 | 40 | 87.0 | 93.0 | 99.3 | 532 | 3.6 | |
| B-64 | 500 | 40 | 87.0 | 93.0 | 99.3 | — | — | Adhesion occurred |
| B-65 | 400 | 3 | 87.0 | 93.0 | 99.3 | 485 | 2.8 | |
| B-66 | 400 | 10 | 87.0 | 93.0 | 99.3 | 495 | 3.2 | |
| B-67 | 400 | 20 | 87.0 | 93.0 | 99.3 | 520 | 3.5 | |
| B-01 | 400 | 40 | 87.0 | 93.0 | 99.3 | 530 | 4.1 | |
| B-68 | 400 | 70 | 87.0 | 93.0 | 99.3 | 520 | 3.8 | |
| B-69 | 400 | 80 | 87.0 | 93.0 | 99.3 | — | — | Cracks occurred |

*Regarding the samples of Nos. 54 to 57, correction has been made of the values of elongation Here, comparing the samples of Nos. B-53 to B-58 in Table 18, the effect of the upsetting ratio that is brought about when cold forging is done at room temperature is searched. From those results, it is found that, even in the case of cold forging, the sample has the level of mechanical property that is as high as 480 MPa or more of tensile strength and 3% or more of elongation, if the upsetting ratio is set in a range of from 3 to 40. Contrary to the above, if the upsetting ratio exceeds 40%, cracks occurs in the sample due to forging. The performance of the test in such a case has been cancelled.

Also, the effect of the heating temperature in a case where hot forging is performed is searched by comparing the samples of Nos. B-01, B-57 (cold forging), and B-59 to B-64 in Table 18 wherein that heating temperature for sintered compact is changed. From those results, it is found that, even in the case of cold forging, the product possibly possesses mechanical properties of high level such that the tensile strength is 480 MPa or more and the elongation is 2% or more, provided that the upsetting ratio is kept in the range of 3 to 40%. In contrast, if the upsetting ratio exceeds 40%, cracking occurs on the sample due to the forging. The succeeding test in such a case has therefore been cancelled.

Moreover, the effect of the heating temperature in the case of hot forging is searched by comparing the samples of No. B-01, B-57 (cold forging), and B-59 to B-64 in Table 18, wherein the temperature for the sintered compact to be forged is changed. From those results, it is found that, although even the product by cold forging possibly has a tensile strength at a high value of about 500 MPa, the tensile strength possibly in the case of hot forging exceeds 500 MPa, while the elongation is possibly improved to a value of about 3% or more. This is attributable to the fact that, although hair cracks very slightly remain within the sample in case of cold forging, followed by decrease in the elongation, the hair cracks is made lost by carrying out hot forging with the material heating temperature being set to 100 degrees C. or more. However, if the forging temperature exceeds 400 degrees C., adhesion (die galling) of the sintered compact to the die occurs. The succeeding test in such a case has been therefore cancelled.

Also, comparing the samples of Nos. 65 to 69 in Table 18, the effect of the upsetting ratio in the case where hot forging is done is searched. From those results, it is found that, in the case of hot forging, the samples have a high level of tensile strength and a high value of elongation even when the upsetting ratio is extended to a wide range of 3 to 70%. However, if the upsetting ratio exceeds 70%, forging causes the occurrence of cracks on the samples. The succeeding test in such a case has been therefore cancelled.

It must be understood that the invention is in no way limited to the above embodiments and that many changes may be brought about therein without departing from the scope of the invention as defined by the appended claims.

What is claimed is:

1. A method of manufacturing a sintered aluminum-based part exhibiting a tensile strength of 480 MPa or more and an elongation of 2% or more, comprising:

preparing a raw material powder comprising, by mass: 3.0 to 10% zinc; 0.5 to 5.0% magnesium, 0.5 to 5.0% copper, inevitable amount of impurities; and aluminum, with use of at least 15 mass % of a simple aluminum powder relative to the raw material powder, wherein the zinc content of the raw material powder is in the form of an aluminum-zinc alloy powder;

forming the raw material powder into a compact having a density ratio of 90% or more by pressing the raw material powder at a pressure of 200 MPa or more;

sintering the compact in a non-oxidizing atmosphere in such a manner as to heat the compact at a sintering temperature of 590 to 610 degrees C. for 10 minutes or more, before cooling the sintered compact; and forging the sintered compact having a density ratio of 93% or more, by pressing the sintered compact in a pressing direction at an upsetting ratio of 10% or more to compress the sintered compact in the pressing direction and produce plastic flow of material in a direction crossing to the pressing direction, with the density ratio of the forged compact increasing to 98% or more and pores of the forged compact closed and formed with metallic bond, wherein the forging comprises one of cold forging and hot forging, the cold forging comprising pressing the sintered compact at a room temperature with an upsetting ratio being in a range of 10 to 40%, and the hot forging comprising pressing the sintered compact at a temperature of 100 to 450 degrees C. with an upsetting ratio being in a range of 10 to 70%.

2. The manufacturing method of claim 1, wherein the temperature of the hot forging excludes a range of 300 degrees C. or more.

3. The manufacturing method of claim 1, wherein the compacting pressure is 400 to 500 MPa, and the density ratio of the compact formed at the forming is 95% or more.

4. The manufacturing method of claim 1, wherein the preparing of the raw material powder comprises mixing an aluminum powder with: a magnesium powder; a copper powder; and an additive powder in the form of alloy powder or a mixture of simple metal powders, the additive powder comprising at least two elements which are selected from the group consisting of zinc, magnesium, copper and aluminum.

5. The manufacturing method of claim 4, wherein the aluminum powder has a particle size of 140 microns or less, and each of the magnesium powder, the copper powder and the additive powder has a particle size of 74 microns or less.

6. The manufacturing method of claim 1, wherein the forging comprises hot forging to press the sintered compact at a temperature of 200 to 400 degrees C. with an upsetting ratio of 20 to 70%.

7. The manufacturing method of claim 6, wherein the aluminum alloy powder has a composition comprising 10 to 30 mass % of zinc, an inevitable amount of impurities and the balance aluminum.

8. The manufacturing method of claim 6, wherein the aluminum alloy powder further comprises copper at a ratio of 10 mass % or less to the aluminum alloy powder.

9. The manufacturing method of claim 6, wherein each of the simple aluminum powder and the aluminum alloy powder has a particle size of 140 microns or less, and each of magnesium and copper is blended into the raw material powder in a form of powder having a particle size of 74 microns or less.

10. The manufacturing method of claim 1, wherein the raw material powder further comprises at least one sintering aid powder which is selected from the group consisting of a simple tin powder, a simple bismuth powder, a simple indium powder and both of an eutectic compound powder and a monotactic compound powder both of which comprise at least one element of tin, bismuth and indium as a main component and both of which produce an eutectic liquid phase of the main component at the sintering, and the ratio of the sintering aid powder to the raw material powder is 0.01 to 0.5 mass %.

11. The manufacturing method of claim 1, wherein the sintering comprises: elevating the temperature in a temperature range of 400 degrees C. to the sintering temperature at an elevating rate of 10 degrees C./minute.

12. The manufacturing method of claim 1, wherein the non-oxidizing atmosphere at the sintering is a nitrogen gas atmosphere having a dew point of −40 degrees C. or less.

13. The manufacturing method of claim 1, further comprising: subjecting the forged compact to heat treatment comprising: heating the forged compact at a temperature of 460 to 490 degrees C. and water-quenching so as to dissolve a precipitation phase in the aluminum base of the forged compact to produce solid solution; and keeping the temperature in a range of 110 to 200 degrees C. for 1 to 28 hours to produce a precipitation phase from the solid solution.

14. The manufacturing method of claim 1, wherein the cooling of the sintered compact to room temperature is a rate of −10 degrees C./min.

15. The manufacturing method of claim 1, wherein the tensile strength of the sintered aluminum-based part is 500 MPa or more.

16. A method of manufacturing a sintered aluminum-based part exhibiting a tensile strength of 480 MPa or more and an elongation of 2% or more, comprising:

preparing a raw material powder comprising, by mass: 3.0 to 10% zinc; 0.5% to 5.0% magnesium; 0.5 to 5.0% copper; inevitable amount of impurities; and aluminum, with use of at least 15 mass % of a single aluminum powder relative to the raw material powder;

forming the raw material powder into a compact having a density ratio of 90% or more by pressing the raw material powder at a pressure of 200 MPa or more;

sintering the compact in a non-oxidizing atmosphere in such a manner as to heat the compact at a sintering temperature of 590 to 610 degrees C. for 10 minutes or more, before cooling the sintered compact; and forging the sintered compact having a density ratio of 93% or more, by pressing the sintered compact in a pressing direction at an upsetting ratio of 10% or more to compress the sintered compact in the pressing direction and produce plastic flow of material in a direction crossing to the pressing direction, with the density ratio of the forged compact increasing to 98% or more and pores of the forged compact closed and formed with metallic bond, wherein the forging comprises cold forging comprising pressing the sintered compact at a room temperature with an upsetting ratio being in a range of 10 to 40%.

17. The manufacturing method of claim 16, wherein the preparing of the raw material powder comprises mixing an aluminum powder with zinc powder, a magnesium powder, and a copper powder, and wherein the aluminum powder has a particle size of 140 microns or less, and each of the zinc powder, the magnesium powder, and the copper powder has a particle size of 74 microns or less.

* * * * *